United States Patent [19]

Alig et al.

[11] Patent Number: 4,697,120

[45] Date of Patent: Sep. 29, 1987

[54] COLOR DISPLAY SYSTEM WITH ELECTROSTATIC CONVERGENCE MEANS

[75] Inventors: Roger C. Alig, Princeton Junction; Stanley Bloom, Bridgewater; Eric F. Hockings, Princeton, all of N.J.

[73] Assignee: RCA Corporation, Princeton, N.J.

[21] Appl. No.: 878,788

[22] Filed: Jun. 26, 1986

[51] Int. Cl.[4] ..... H01J 29/51; H01J 29/62

[52] U.S. Cl. ..... 313/412; 313/413; 313/414; 313/439

[58] Field of Search ..... 313/412, 413, 425, 432, 313/439, 414

[56] References Cited

U.S. PATENT DOCUMENTS

| | | | |
|---|---|---|---|
| 2,907,915 | 10/1959 | Gleichauf | 315/13 |
| 3,317,769 | 5/1967 | Johnson | 313/439 |
| 3,590,302 | 6/1971 | Bussey . | |
| 3,614,502 | 10/1971 | Doggett et al. . | |
| 3,778,666 | 12/1973 | Miyaoka et al. | 315/13 C |
| 3,916,244 | 10/1975 | Evans, Jr. | 313/412 |
| 4,291,251 | 9/1981 | Bijma et al. | 313/413 |
| 4,470,029 | 9/1984 | Chase | 335/210 |

*Primary Examiner*—Palmer C. DeMeo

*Attorney, Agent, or Firm*—Eugene M. Whitacre; Dennis H. Irlbeck

[57] ABSTRACT

A color display system includes a cathode-ray tube and yoke. The yoke is a non-converging type. The cathode-ray tube has en electron gun assembly for generating and directing three electron beams, located at the corners of an equilateral triangle, along paths toward a screen of the tube. The electron gun assembly comprises three electron guns each including electrodes that comprise a beam-forming region and electrodes that form a main focusing lens in the path of each electron beam. The main focusing lens is formed by at least two focusing electrodes. The focusing electrode closest to the beam-forming region includes a separated part adjacent to the paths of each of the electron beams. Each separated part forms a portion of the dipole lens structure in the path of an electron beam. Means are provided for applying dynamic signals to the separated parts which are related to the deflection of the electron beams. The dipole lens structures establish electrostatic dipole fields in the path of the three electron beams that cause the beams to converge at the screen for all angles of deflection.

7 Claims, 11 Drawing Figures

COLOR DISPLAY SYSTEM WITH ELECTROSTATIC CONVERGENCE MEANS

The present invention relates to color display systems including cathode-ray tubes having delta electron gun assemblies, and particularly to such gun assemblies having means therein for providing electrostatic dynamic convergence of the electron beams formed by the electron gun assemblies.

BACKGROUND OF THE INVENTION

Prior to development of self-converging yokes, beam convergence was usually achieved by use of dynamically varied magnetic fields that were coupled to plates or pole pieces located inside the neck of the tube at the output end of an electron gun assembly. The magnetic fields were formed by electromagnetic components located outside the neck of the tube. However, the adjustments for such a dynamic convergence system were extremely complex and time consuming. In response to this adjustment problem, a system utilizing a self-converging yoke was developed.

Although most present-day deflection yokes produce a self-convergence of the three beams in a cathode-ray tube, the price paid for such self-convergence is a deterioration of the individual electron beam spot shapes. The self-converging yoke magnetic field is astigmatic. It both overfocuses the vertical-plane electron beam rays, leading to deflected spots with appreciable vertical flare, and underfocuses the horizontal rays, leading to slightly enlarged spot width.

It is desirable to avoid the astigmatism problem associated with a self-converging yoke by using a yoke that is not self-converging. However, it is not desirable to return to use of dynamically varied magnetic fields for converging the beams.

The present invention provides a system that uses both a yoke that is non-converging and a delta electron gun assembly that includes means for converging the electron beams.

SUMMARY OF THE INVENTION

A color display system includes a cathode-ray tube and yoke. The yoke is a non-converging type. The cathode-ray tube has an electron gun assembly for generating and directing three electron beams, located at the corners of an equilateral triangle, along paths toward a screen of the tube. The electron gun assembly comprises three electron guns each including electrodes that comprise a beam-forming region and electrodes that form a main focusing lens in the path of each electron beam. The main focusing lens is formed by at least two focusing electrodes. The focusing electrode closest to the beam-forming region includes a separated part adjacent to the paths of each of the electron beams. Each separated part forms a portion of a dipole lens structure in the path of an electron beam. Means are provided for applying to the separated parts dynamic signals which are related to the deflection of the electron beams. The dipole lens structures establish electrostatic dipole fields in the paths of the three electron beams that cause the beams to converge at the screen for all angles of deflection.

DETAILED DESCRIPTION OF THE PREFERRED EMBODIMENTS

Figure 1:
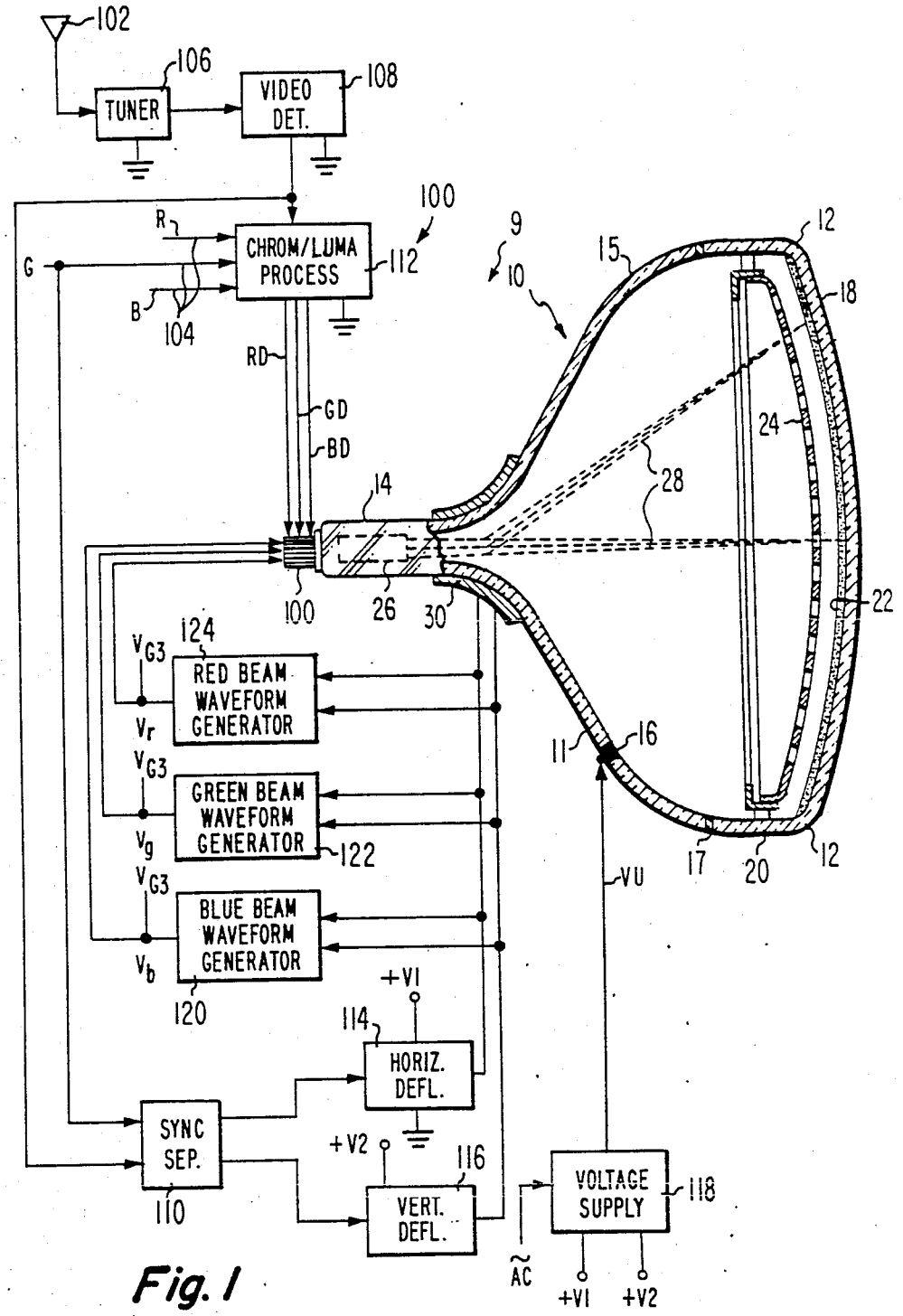
FIG. 1 is a plan view, partly in axial section, of a color display system embodying the invention.
Figure 2:
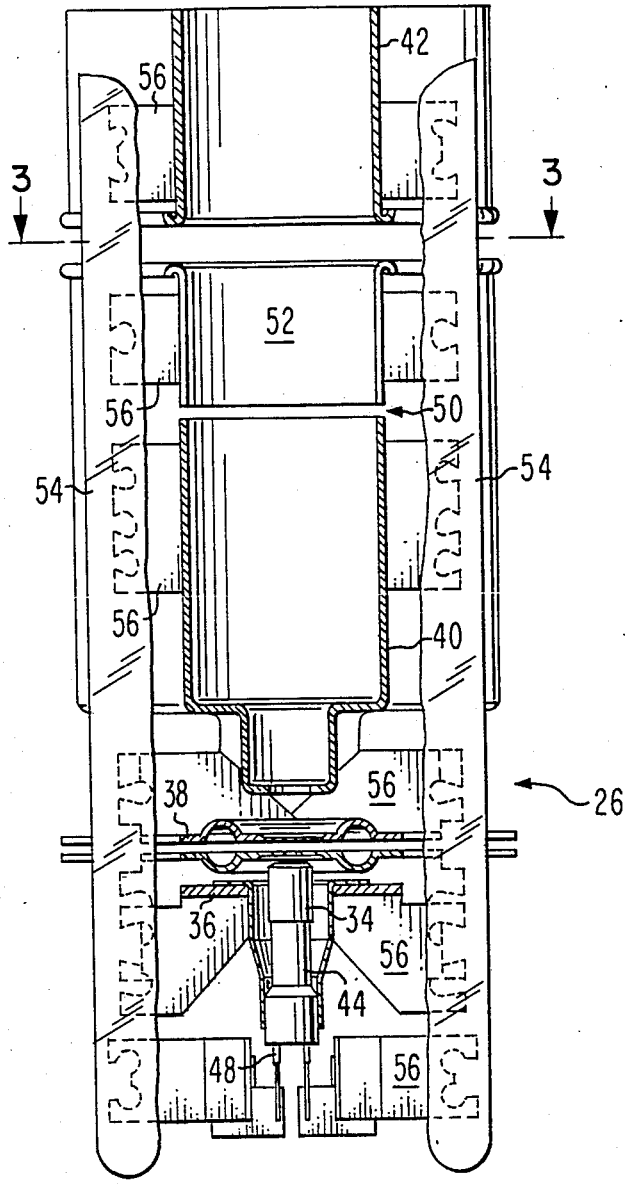
FIG. 2 is a partially cutaway section top view of the electron gun assembly shown in dashed lines in FIG. 1.
Figure 3:
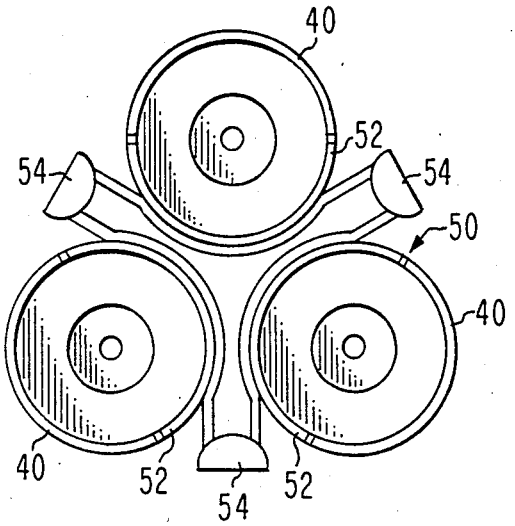
FIG. 3 is a sectional view of the electron gun assembly taken at line 3—3 of FIG. 2.
Figure 4:
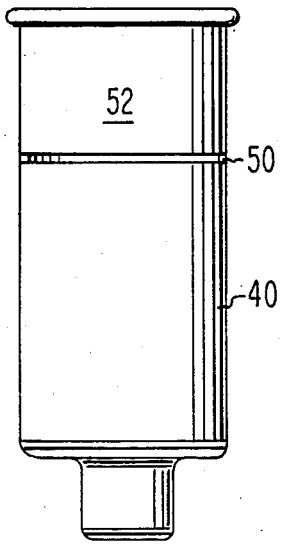
FIGS. 4 and 5 are plan and side views, respectively, of a G3 electrode of the electron gun assembly of FIG. 2.
Figure 5:
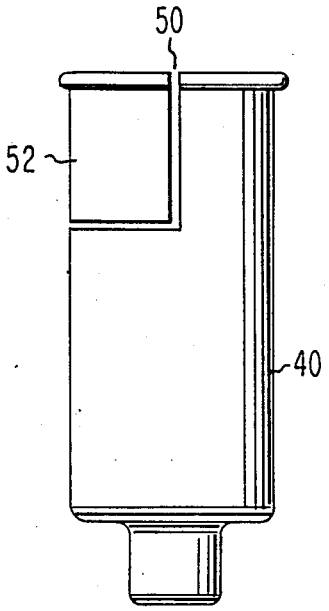

FIG. 1 shows a color display system 9 including a rectangular color picture tube 10 having a glass envelope 11 comprising a rectangular faceplate panel 12 and a tubular neck 14 connected by a rectangular funnel 15. The funnel 15 has an internal conductive coating (not shown) that extends from an anode button 16 to the neck 14. The panel 12 comprises a viewing faceplate 18 and a peripheral flange or sidewall 20 which is sealed to the funnel 15 by a glass frit 17. A three-color phosphor screen 22 is carried by the inner surface of the faceplate 18. The screen 22 preferably is a dot screen with the phosphor dots arranged in triads, each triad including a phosphor dot of each of the three colors. Alternatively, the screen can be a line screen. A multiapertured color selection electrode or shadow mask 24 is removably mounted, by conventional means, in predetermined spaced relation to the screen 22. An improved delta electron gun assembly 26, shown schematically by dotted lines in FIG. 1, is centrally mounted within the neck 14 to generate and direct three electron beams 28 along convergent paths through the mask 24 to the screen 22.

The tube of FIG. 1 is designed to be used with an external magnetic deflection yoke, such as the yoke 30 shown in the neighborhood of the funnel-to-neck junction. When activated, the yoke 30 subjects the three beams 28 to magnetic fields which cause the beams to scan horizontally and vertically in a rectangular raster over the screen 22. The initial plane of deflection (at zero deflection) is at about the middle of the yoke 30. Because of fringe fields, the zone of deflection of the tube extends axially from the yoke 30 into the region of the gun assembly 26. For simplicity, the actual curvature of the deflection beam paths in the deflection zone is not shown in FIG. 1. In the preferred embodiment, the yoke 30 is a non-converging type and does not converge the electron beams as does a self-converging yoke.

FIG. 1 also shows a portion of the electronics used for exciting the tube 10 and yoke 30. These electronics are described below.

The details of the delta electron gun assembly 26 are shown in FIGS. 2, 3, 4 and 5. The gun assembly 26 includes three substantially identical electron guns disposed in the neck 14 and adapted to project three separate electron beams through the deflection zone toward the screen 22. Each of the electron guns is spaced at the corners of an equilateral triangle. Each of the three guns comprises a cathode assembly 34, a control grid electrode 36 (G1), a screen grid electrode 38 (G2), an accelerating first main focusing electrode 40 (G3), and a second main focusing lens electrode 42 (G4), spaced in the order named. Each of the G1 through G4 electrodes may be single electrodes for each beam, as shown, or alternatively, the gun assembly may be of unitized construction, as is shown and described later with respect to FIGS. 10 and 11.

Each cathode assembly 34 comprises a tubular sleeve 44 closed at one end with a cap 46 that includes an electron emissive material thereon. A heater 48 is located inside the open end of the cathode sleeve. Each G1 control grid electrode 36 comprises an apertured portion encompassing a 120° sector. Three portions, one for each beam, fit together in a spaced relationship. Each G2 screen grid electrode 38 also comprises an apertured portion encompassing a 120° sector with the three portions fitting together in a spaced relationship. Each G3 accelerating electrode 40 comprises a cylindrical tube that is stepped-down in diameter at a closed apertured end that faces a G2 screen grid electrode 38. As shown best in FIGS. 4 and 5, the open end of each G3 electrode 40 is sectioned by a gap 50 that extends centrally down through the open end and then, at a right angle out through the side of the electrode, thus forming a separate segmented portion 52.

All of the electrodes of the gun assembly 26 are either directly or indirectly connected to three insulative support rods 54. The rods 54 may extend to and support the G1 electrode 36 and the G2 electrode 38, or these two electrodes may be attached to the G3 electrode 40 by some other insulative means. In a preferred embodiment, the support rods are of glass, which has been heated and pressed onto claws extending from brackets 56 attached to the electrodes, to embed the claws in the rods.

Referring back to FIG. 1, there is shown a portion of the electronics 100 that may operate the system as a television receiver and as a computer monitor. The electronics 100 is responsive to broadcast signals received via an antenna 102, and to direct red, green and blue (RGB) video signals via input terminals 104. The broadcast signal is applied to tuner and intermediate frequency (IF) circuitry 106, the output of which is applied to a video detector 108. The output of the video detector 108 is a composite video signal that is applied to a synchronizing signal (sync) separator 110 and a chrominance and luminance signal processor 112. The sync separator 110 generates horizontal and vertical synchronizing pulses that are, respectively, applied to horizontal and vertical deflection circuits 114 and 116. The horizontal deflection circuit 114 produces a horizontal deflection current in a horizontal deflection winding of the yoke 30, while the vertical deflection circuit 116 produces a vertical deflection current in a vertical deflection winding of the yoke 30.

In addition to receiving the composite video signal from the video detector 108, the chrominance and luminance signal processing circuit 112 alternatively may receive individual red, green and blue video signals from a computer, via the terminals 104. Synchronizing pulses may be supplied to the sync separator 110 via a separate conductor or, as shown in FIG. 1, associated with the green video signal. The output of the chrominance and luminance processing circuitry 112 comprises the red, green and blue color drive signals, that are applied to the electron gun assembly 26 of the cathode ray tube 10 via conductors RD, GD and BD, respectively.

Power for the system is provided by a voltage supply 118, which is connected to an AC voltage source. The voltage supply 118 produces a regulated DC voltage level $+V_1$ that may, illustratively, be used to power the horizontal deflection circuit 114. The voltage supply 118 also produces DC voltage $+V_2$ that may be used to power the various circuits of the electronics, such as the vertical deflection circuit 116. The voltage supply further produces a high voltage $V_u$ that is applied to ultor terminal or anode button 16.

Circuits and components for the tuner 106, video detector 108, sync separator 110, processor 112, horizontal deflection circuit 114, vertical deflection circuit 116 and voltage supply 118 are well known in the art and, therefore, are not specifically described herein.

In addition to the foregoing elements, the electronics 100 includes three convergence waveform generators 120, 122 and 124. The convergence waveform generators 120, 122 and 124 provide dynamically varied voltage $V_b$, $V_g$ and $V_r$ to the sectioned portions of the electron gun 26. Each generator receives the horizontal and vertical scan signals from the horizontal deflection circuit 114 and the vertical deflection circuit 116, respectively. The circuitry for the generators 120, 122 and 124 can be that as is known in the art. Examples of such known circuits may be found in: U.S. Pat. No. 4,214,188, issued to Bafaro et al. on July 22, 1980; U.S. Pat. No. 4,258,298, issued to Hilburn et al. on Mar. 24, 1981; and U.S. Pat. No. 4,316,128, issued to Shiratsuchi on Feb. 16, 1982. These patents are hereby incorporated by reference for their showings of such dynamic circuitry.

Figure 6:
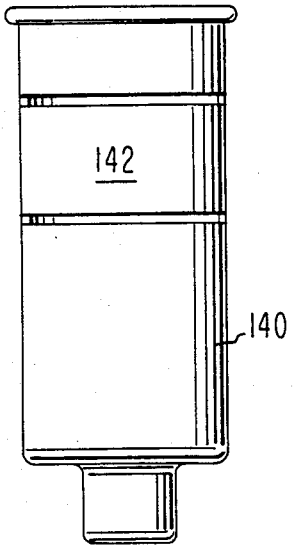
FIGS. 6 and 7 are plan and side views, respectively, of another G3 electrode embodiment.
Figure 7:
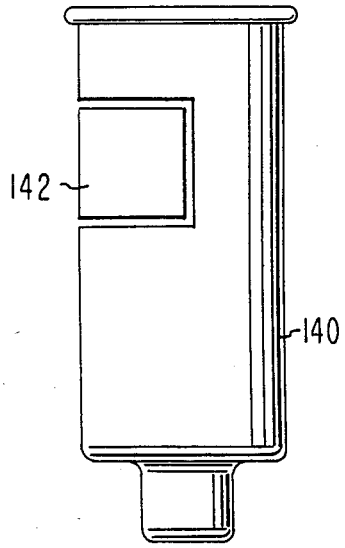

FIGS. 6 and 7 show an alternate embodiment for the G3 first main focusing lens electrodes. In this embodiment, a first main focusing lens electrode 140 has a segmented portion 142 that is set-back from the focusing lens end of the electrode. In this location, the segmented portion 142 has less of an affect on the main focusing lens than in the preceding embodiment.

Figure 8:
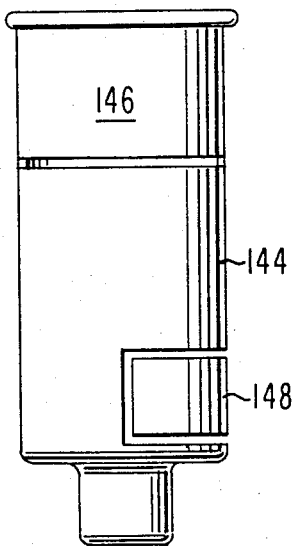
FIGS. 8 and 9 are plan and side views, respectively, of yet another G3 electrode embodiment.
Figure 9:
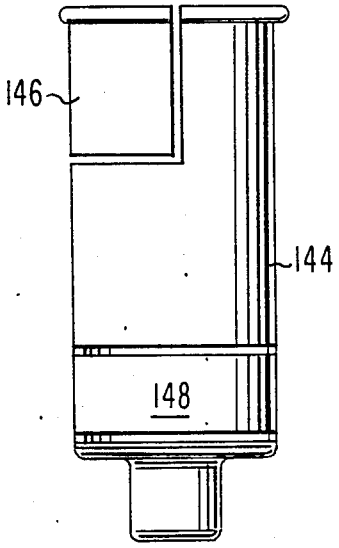

A fourth degree of freedom, to assure lateral convergence of the electron beams in the vertical plane that passes through the central longitudinal axis of the electron gun, can be obtained by including an additional segmented portion in one of the electrodes. FIGS. 8 and 9 show a first main focusing lens electrode 144 having a segmented portion 146, that is identical to the segmented portion 52 of the electrode 40 of FIGS. 4 and 5, and a second segmented portion 148 that is near the cathode side of the electrode. The second segmented portion is oriented perpendicularly to the segmented portion 146.

Figure 10:
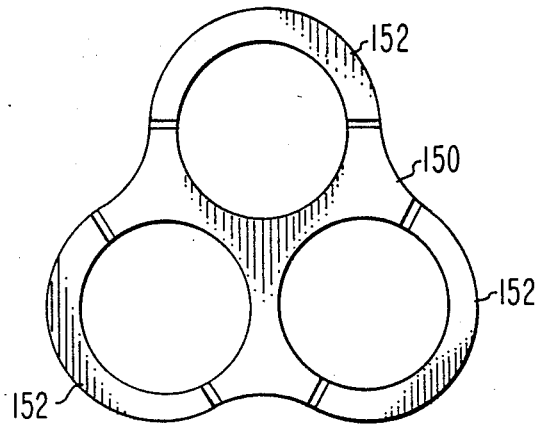
FIGS. 10 and 11 are top and side views, respectively, of a unitized G3 electrode embodiment.
Figure 11:
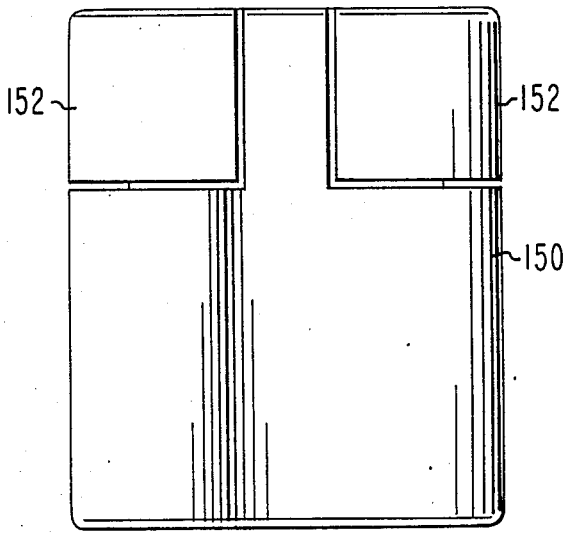

The preceding embodiments have been presented as non-unitized electron guns having individual electrodes for each electron beam. However, the scope of the present invention also covers unitized electron guns wherein the electron beams share common electrodes. FIGS. 10 and 11 show a first main focusing lens electrode 150 having three segmented portions 152.

What is claimed is:

1. In a color display system including a cathode-ray tube having an electron gun assembly for generating and directing three electron beams, located at the corners of an equilateral triangle, along paths toward a screen of said tube, said gun assembly comprising three electron guns each including electrodes comprising a beam-forming region and electrodes for forming a main focusing lens, and said system including a non-converging yoke, the improvement comprising the main focusing lens electrode of each electron gun closest to the beam-forming region including means for forming a separate electrostatic dipole field in the path of an associated electron beam and the dipole fields being oriented to cause the electron beams to converge at the screen for all angles of deflection.

2. The color display system as defined in claim 1, wherein said electron gun assembly is non-unitized having three electron guns that include separate cylindrical tube elements.

3. The color display system as defined in claim 1, wherein said electron gun assembly is unitized having three electron guns formed by common elements.

4. The color display system as defined in claim 1, wherein one of said electron guns includes means for forming another electrostatic dipole field therein that is oriented perpendicular to the other dipole field therein to affect lateral movement of an associated electron beam relative to the other two electron beams.

5. In a color display system including a cathode-ray tube having an electron gun assembly for generating and directing three electron beams, located at the corners of an equilateral triangle, along paths toward a screen of said tube, said gun assembly comprising three electron guns each including electrodes comprising a beam-forming region and electrodes for forming a main focusing lens, and said system including a non-converging yoke, the improvement comprising the main focusing lens electrode of each electron gun closest to the beam-forming region including a separated part, the separated part forming a portion of an aperture in said electrode closest to the beam-forming region, the remaining portion of the aperture being formed by another part of said electrode closest to the beam-forming region, and means for applying dynamic signals to said separated parts which are related to deflection of the electron beams.

6. The color display system as defined in claim 5, wherein said electron gun assembly is non-unitized having three electron guns that include separate cylindrical tube elements.

7. The color display system as defined in claim 5, wherein said electron gun assembly is unitized having three electron guns formed by common elements.

* * * * *